United States Patent [19]

Milillo

[11] Patent Number: 4,526,464

[45] Date of Patent: Jul. 2, 1985

[54] JAM CLEARANCE BAFFLE

[75] Inventor: William D. Milillo, Fairport, N.Y.

[73] Assignee: Xerox Corporation, Stamford, Conn.

[21] Appl. No.: 549,948

[22] Filed: Nov. 9, 1983

[51] Int. Cl.[3] ..... G03G 21/00; B65H 7/00

[52] U.S. Cl. ..... 355/3 SH; 271/278; 271/8.1

[58] Field of Search ..... 355/3 SH, 3 DR, 3 TR, 355/3 R; 271/8 R, 273, 275, 278, 314

[56] References Cited

U.S. PATENT DOCUMENTS

| | | | |
|---|---|---|---|
| 3,940,126 | 2/1976 | Cooper | 271/174 |
| 4,278,341 | 7/1981 | Burgess et al. | 355/3 SH |
| 4,412,734 | 11/1983 | Shibaya et al. | 355/3 SH |
| 4,464,042 | 7/1984 | Omori et al. | 355/3 SH |

*Primary Examiner*—A. T. Grimley
*Assistant Examiner*—J. Pendegrass

[57] ABSTRACT

Sheet transport apparatus together with reproducing apparatus employing the sheet transport apparatus are provided, wherein a portion of the sheet transport comprises a first sheet guide member and a second sheet guide member in opposed spaced guiding relationship to the first sheet guide member, and defining therebetween a portion of a sheet transport path. The second sheet guide member is pivotally mounted at its upstream end and has attached at its downstream end a U-shaped member which extends from said second sheet guide member through the defined sheet transport path and into the plane of said first sheet guide member defining an aperture therein enclosing a cross sectional slice of said transport path. With this apparatus, when a sheet is transported through a portion of the sheet transport path, it passes within the aperture formed by the U-shaped member and the second sheet guide member. In a preferred embodiment the pivotally mounted second sheet guide member, together with its U-shaped member provide a means for readily clearing a copy paper jam adjacent to the photoreceptor without the necessity of physically contacting the photoreceptor.

15 Claims, 5 Drawing Figures

JAM CLEARANCE BAFFLE

BACKGROUND OF THE INVENTION

The present invention relates to electrostatographic reproducing apparatus and more particularly to a novel sheet transport apparatus for use therein. More specifically, the present invention is directed to a jam clearance baffle for use in removing jammed copy sheets from a sheet transport path without the necessity of physical contact between the operator and the affected units.

In electrostatographic reproducing apparatus commonly used today, a photoconductive insulating member is typically charged to a positive potential, thereafter exposed to a light image of an original document to be reproduced. The exposure discharges the photoconductive insulating surface in exposed or background areas and creates an electrostatic latent image on the member which corresponds to the image areas contained within the original document. Subsequently, the electrostatic latent image on the photoconductive insulating surface is made visible by developing the image with a developing powder referred to in the art as toner. During development the toner particles are attracted from the carrier particles by the charge pattern of the image areas on the photoconductive insulating area to form a powder image on the photoconductive area. This image may be subsequently transferred to a support surface such as copy paper to which it may be permanently affixed by heating or by the application of pressure. Following transfer of the toner image to the support surface the photoconductive insulating surface may be discharged and cleaned of residual toner to prepare for the next imaging cycle.

One of the difficulties frequently encountered in an automatic reproducing apparatus has to do with the occurrence of paper jams at virtually any point in the copy sheet path. The paper jams are caused as a result of paper trying to negotiate curves and baffles or the paper itself having torn edges, dog ears or being curled. The defects in the individual copy sheets could of course cause a paper jam in any place in the paper path in the machine. Frequently paper jams take place adjacent to major operational stations in the machine wherein significant operations are performed on the paper. For example, jams can take place at the entrance to the transfer station where the copy sheet is brought into contact with the photoreceptor for the transfer of the toner image to the photoreceptor. Similarily the difficulties may occur at the fixing station wherein the toner image on the copy sheet is fixed onto the copy paper. In the instance where the copy sheet is brought into contact with the photoreceptor which typically is in the form of a rotatably cylindrical drum or a reusable belt, the leading edge of the copy sheet is tacked to the photoreceptor in registration with the leading edge of the toner image on the drum. If a paper jam occurs, the operator may remove a cover of the machine and manually reach in and attempt to withdraw or extract the paper from the jammed condition. In the process of trying to withdraw or extract the copy sheet from the jammed position, the possibility of damaging the photoreceptor is greatly increased. For example, the photoreceptor can be damaged by being contacted with fingernails of the operator, which can scratch the photoreceptor surface which ultimately may affect the electrical properties providing non-uniform charging of the photoreceptor on subsequent imaging cycles. Furthermore it is possible that fingerprints may also be placed on the photoreceptor which can also result in cyclical imaging problems. With respect to difficulties encountered with the fixing device, which typically involves hot surfaces such as a radiant fuser or heated roll fuser, the manual extraction of a jammed copy sheet increases the possibility of the operator being burned by contact with a heated surface.

Typically in the prior art, it has been the practice to have either the upper or the lower transports of the paper path movable out of the paper path so that the copy sheet could be physically, manually extracted by the operator. As noted previously, while the jammed copy sheet can be manually extracted, this creates the possibility of damage to either operational portions of the machine or to the operator extracting the jammed copy sheet. Thus, for example, in the copy sheet sorter associated with the 7700, the top transport of the sorter module is pivotably opened so that the copy sheets can be manually extracted.

PRIOR ART

U.S. Pat. No. 3,940,120 (Copper) shows a copying apparatus with a stripping device positioned immediately below the beginning of a transport path and immediately above the photoreceptor surface. The stripping device is separate from the transport path.

U.S. Pat. No. 4,278,341 (Burgess et al.) describes a blade for stripping a sheet from a photoreceptor drum. The blade is pivotable between two positions. In one position, the blade engages the core of a copy sheet to remove it from the photoreceptor drum. In another position the blade is moved away from the photoreceptor surface.

SUMMARY OF THE INVENTION

In accordance with the present invention a copy sheet transport apparatus together with reproducing apparatus employing the copy sheet transport apparatus is provided.

In accordance with the principal aspect of the present invention, a portion of the copy sheet transport apparatus comprises a first sheet guide member partially defining a portion of the sheet transport path, a second sheet guide member in opposed spaced guiding relationship to the first guide member and defining therebetween a portion of the sheet transport path, the second sheet guide member being pivotally mounted at its upstream end and having attached at its downstream end a U-shaped member which extends from the second sheet guide member through the defined sheet transport path and into the plane of the first sheet guide member defining an aperture therein by enclosing a cross sectional slice to said transport path. In such an apparatus, when a sheet is transported through said portion of said sheet transport path it passes within the aperture formed by the U-shaped member and the second sheet guide member.

In a further aspect of the present invention, the first and second sheet guide members are positioned adjacent to the imaging surface and the second sheet guide member may be withdrawn from the sheet transport path to remove any copy sheet that may have been jammed adjacent to the photoreceptor without the necessity of physically contacting the photoreceptor.

In a further aspect of the present invention, the second sheet guide member is on top of the first sheet guide member.

In a further aspect of the present invention, the first sheet guide member is on top of the second sheet guide member.

In an additional aspect of the present invention, the second sheet guide member is pivotally mounted about a hinge which spring biases the second sheet member to the open position.

In a further aspect of the present invention, the U-shaped member is provided with a friction pad to provide a sheet retaining surface for a sheet contained within said aperture.

For a better understanding of the invention as well as other aspects and further features thereof, reference is had to the following drawings and description.

DESCRIPTION OF THE PREFERRED EMBODIMENT

The invention will now be described with reference to a preferred embodiment.

Figure 1:
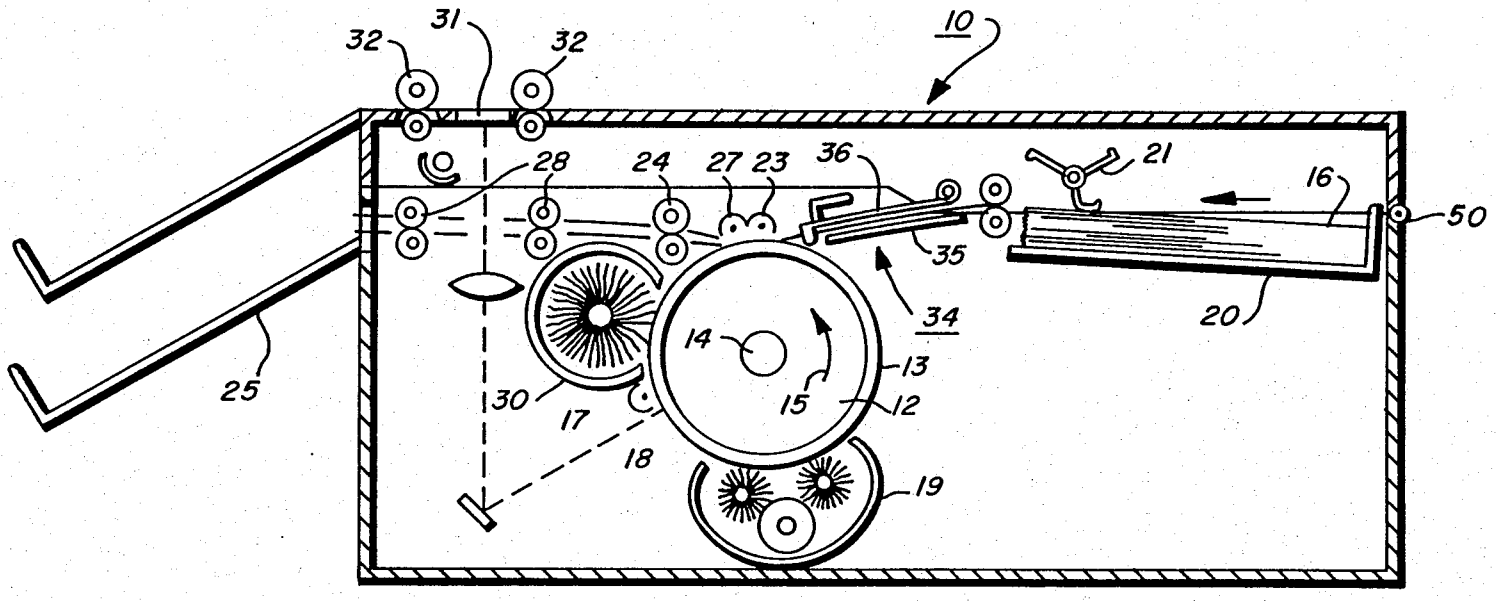
FIG. 1 is a schematic representation in cross section of an automatic electrostatographic reproducing machine with the jam clearance baffle of the present invention.
Figure 3:
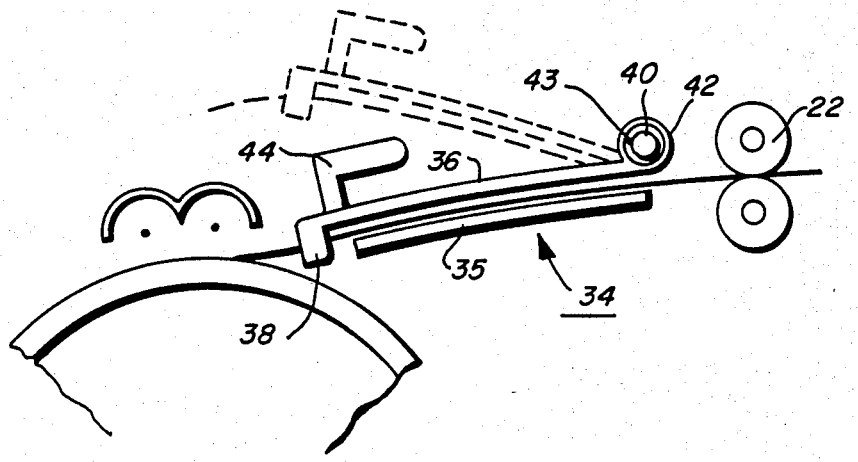
FIG. 3 is a further enlarged sectional view illustrating two positions of the spring biased jam clearance baffle relative to the transfer station on a reusable rotatable imaging drum. The open position is represented in dashed lines.

Referring now to FIG. 1 there is shown by way of example an automatic xerographic reproducing machine 10 which includes the jam clearance baffle of the present invention. The reproducing machine 10 depicted in FIG. 3 illustrates the various components utilized therein for producing copies from an original document. Although the apparatus of the present invention is particularly well adapted for use in an automatic xerographic reproducing machine 10, it should become evident from the following description that is equally well suited for use in a wide variety of processing systems including other electrostatographic systems and it is not necessarily limited in the application to the particular embodiments shown herein.

The reproducing machine 10, illustrated in FIG. 3 employs an image recording drum-like member 12, the outer periphery of which is coated with a suitable photoconductive material 13. The drum 12 is suitably journaled for rotation within a machine frame (not shown) by means of shaft 14 and rotates in the direction indicated by arrow 15 to bring the image-bearing surface 13 thereon past a plurality of xerographic processing stations. Suitable drive means (not shown) are provided to power and coordinate the motion of the various cooperating machine components whereby a faithful reproduction of the original input scene information is recorded upon a sheet of final support material 16 such as paper or the like.

Initially, the drum 12 moves the photoconductive surface 13 through a charging station 17 where an electrostatic charge is placed uniformly over the photoconductive surface 13 in known manner preparatory to imaging. Thereafter, the drum 12 rotates to exposure station 18 where the charged photoconductive surface 13 is exposed to a light image of the original input scene information whereby the charge is selectively dissipated in the light exposed regions to record the original input scene in the form of an electrostatic latent image. After exposure drum 12 rotates the electrostatic latent image recorded on the photoconductive surface 13 to development station 19 wherein a conventional developer mix is applied to the photoconductive surface of the drum 12 rendering the latent image visible. Typically a suitable development station could include a magnetic brush development system utilizing a magnetizable developer mix having coarse ferromagnetic carrier granules and toner colorant particles.

Sheets 16 of the final support maerial are supported in a stack arrangement on an elevating stack support tray 20. With the stack at its elevated position a sheet separator feed paddle wheel 21 feeds individual sheets therefrom to the registration pinch rolls 22. The sheet is then forwarded to the transfer station 23 in proper registration with the image on the drum. The developed image on the photoconductive surface 13 is brought into contact with the sheet 16 of final support material within the transfer station 23 and the toner image is transferred from the photoconductive surface 13 to the contacting side of the final support sheet 16. Following transfer of the image the final support material which may be paper, plastic, etc., as described is transported through detack station where detack corotron 27 uniformly charges the support material to separate it from the drum 12.

After the toner image has been transferred to the sheet of final support material 16 the sheet with the image thereon is advanced to a suitable fixer such as heated roll fuser 24 which coalesces the transferred powder image thereto. After the fusing process the sheet 16 is advanced through transport rolls 28 to a suitable output device such as tray 25.

Although a preponderance of toner powder is transferred to the final support material 16, invariably some residual toner remains on the photoconductive surface 13 after the transfer of the toner powder image to the final support material. Following transfer of the toner image to the final support material, the toner remaining on the drum is removed by brush cleaner 30.

Normally, when the copier is operated in a conventional mode, the original document to be reproduced is placed image side down upon a horizontal transparent viewing platen 31 and the original is then transported by way of rolls 32 past the stationary optical system.

It is believed that the foregoing general description is sufficient for the purposes of the present application to illustrate the general operation of an automatic xerographic copier which can embody the apparatus according to the present invention.

With continued reference to FIG. 1 and additional reference to FIGS. 2–4, the jam clearance baffle of the present invention will be described in greater detail. The baffle 34 is positioned between the copy sheet registration rolls and the toner image transfer station. It provides a major portion of the sheet transport between these two operations. It should be noted that the registration rolls are actuated by means not shown in synchronization with the imaging drum such that the leading edge of the copy sheet, when it arrives at the transfer station, is in registration with the leading edge of the toner image on the drum. The jam clearance baffle 34 comprises a first or lower sheet guide member 35 which partially defines a portion of the sheet transport path and an upper or second sheet guide member 36, which is spaced from and opposed to the lower sheet transport member in sheet guiding relationship therewith. The upper and lower sheet transport members define a sheet transport path through which the sheet may be transported from the registration rolls to the transfer station. The upper sheet guide member has at its end a U-shaped member 38 which extends from the upper sheet guide member 36 downwardly through the sheet transport path defined by the upper and lower guide members and into the plane of the lower guide member 35 defining an aperture therein which would enclose a cross sectional slice of the transport path. Typically, as may be seen with particular reference to FIG. 4, this is a rectangular slot of the order, for example, of about ½ inch in thickness through which the copy sheet is fed. Thus, when a sheet is transported from the registration rolls to the transfer station, it is transported through this slot which extends from the upper guide member through the sheet transport path into the plane of the lower guide member. As illustrated in FIG. 3, the upper guide member is pivotably mounted about shaft 40 through means of pivot hinge 42 for movement upwardly and away from the lower guide member. The upward movement can be applied by means of spring 43 which can bias the upper guide member together with the U-shape member away from the lower guide position as illustrated in the dashed line of FIG. 3.

Figure 4:
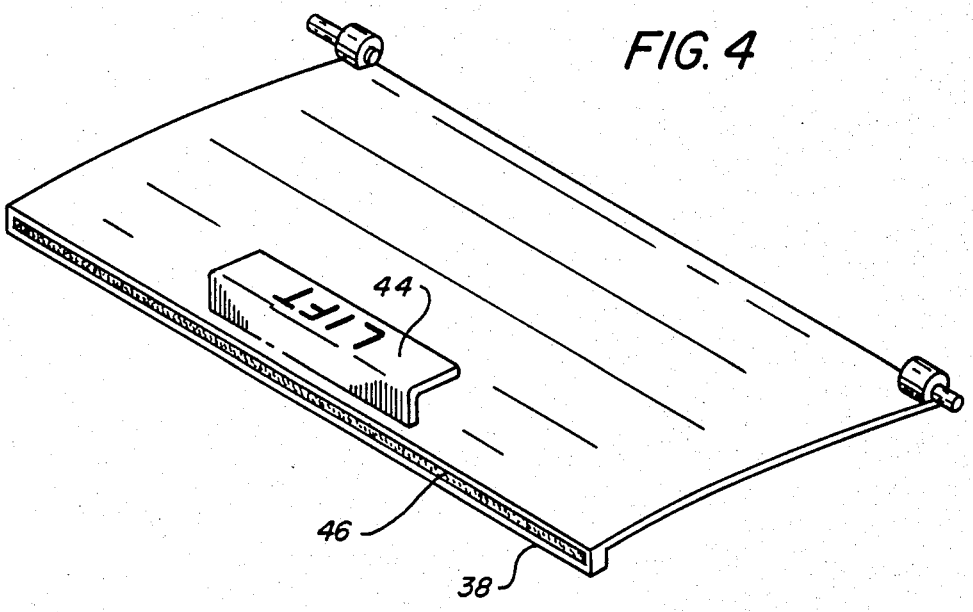
FIG. 4 is an isometric view showing the liftable jam clearance baffle together with a rectangular aperture and containing a friction pad therein.

Alternatively, of course, the lift tab 44 as seen for example in FIG. 4 may be used to manually raise the upper guide member together with the associated U-shape member to the open position. As previously indicated, the top of the automatic reproducing machine may be pivotally mounted about hinge 50 (See FIGS. 1 and 2) which when open permits the spring 43 to automatically urge the upper guide member together with the associated U-shape member into the open position indicated in dashed line of FIG. 3 where the jammed sheet may be readily removed without damage to the imaging surface.

Figure 2:
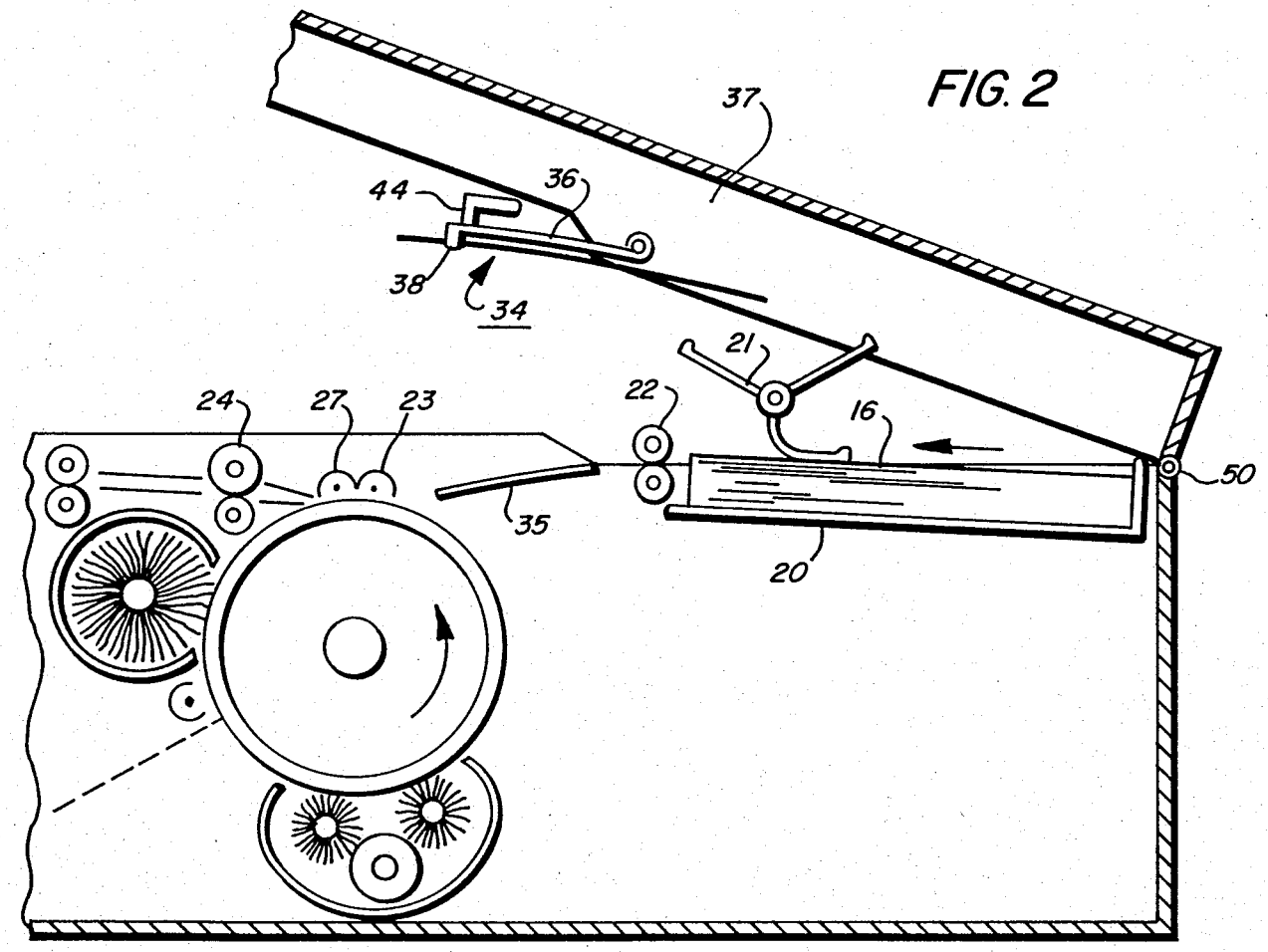
FIG. 2 is an enlarged view of a portion of the machine depicted in FIG. 1 with the top cover of the machine open illustrating the action of the jam clearance baffle.

An alternative embodiment is illustrated in FIG. 2 where the upper guide member is physically attached to the top machine cover 37 so that it is withdrawn as the cover is raised.

During normal sheet feeding operation, the sheet is registered by registration rolls 22 and fed forward into the sheet transport path defined by the upper and lower guide members, and through the U-shaped end portion associated with the upper guide member which extends down into the sheet transport path. The sheet reaches the photoreceptor drum in registration with the leading edge of the image on the drum and the toner image is transferred to the sheet. In the event of a jam in the transfer station, the copy sheet extends through and on both sides of the rectangular aperture defined by the upper guide member and the U-shape member and when the upper guide member is raised to the open position the sheet is also raised to the open position with that portion in the transport zone being extracted from the transfer zone as long as a portion of the jammed sheet is still in the upstream section from the U-shape member. To assist in ensuring that the jammed copy sheet retains its position, the U-shaped baffle may be supplied with a friction pad 46 illustrated in FIG. 4. The jam clearance baffle 34 may be opened by manually withdrawing handle 44 to the open position or alternatively, as indicated in FIG. 3 merely by opening the top of the automatic reproducing machine and having the spring 43 urge the upper guide member into the open position. In this way the jammed copy sheet may be removed from the surface of the delicate photoreceptor drum and manually removed from the machine at a position away from the drum. By so doing, the potential for damage to the drum is substantially reduced if not virtually eliminated.

Figure 5:
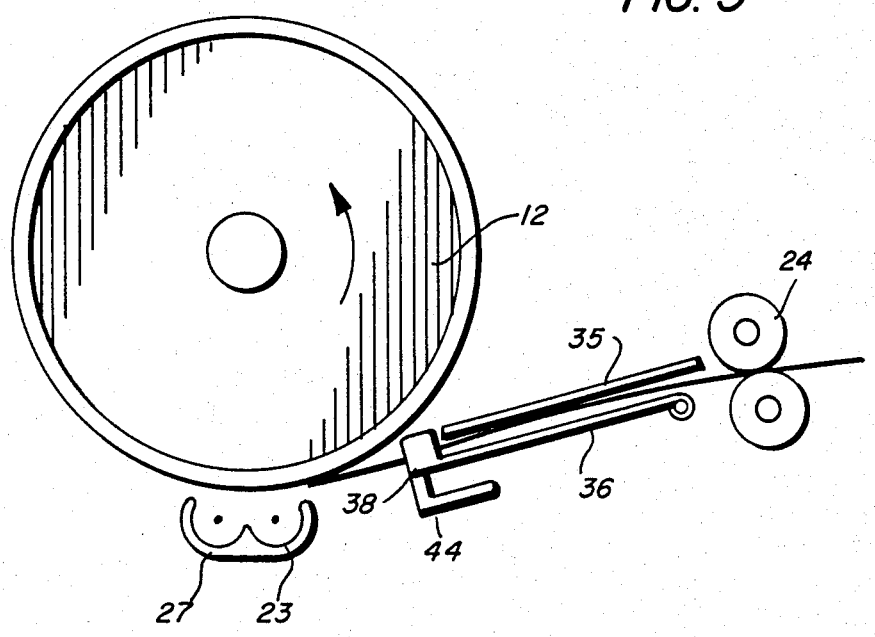
FIG. 5 is an alternative embodiment of the present invention wherein the jam clearance baffle is pivotally mounted to open downward relative to the photoreceptor drum.

FIG. 5 illustrates an alternative embodiment in which the first sheet guide member is the upper guide member and the second sheet guide member is the lower sheet guide member and the U-shaped member attached thereto and extending upwardly into the path of the sheet being fed and into the path of the first or upper sheet guide member. For the sake of ready comparison, all parts are commonly labelled with FIGS. 1–4. This figure illustrates a specific embodiment in which the jam clearance baffle can be mounted to be movable downwardly as opposed to upwardly as illustrated in FIGS. 1–4.

While the jam clearance baffle has been illustrated with particular reference to that portion of the copy transport path between the registration rolls and the transfer station, it should be emphasized that it could be used in any portion of the copy sheet transport path wherein jams are likely to occur and their clearance is required. It is particularly appropriate to be used in those portions of the copy transport path wherein it is possible for damage to the machine to occur by human intervention in extracting a jammed copy sheet or where critical adjustments may be altered. It is, for example, entirely possible to use the subject jam clearance baffle in that portion of the copy sheet transport path leading into the fixing device. The only limitation on the jam clearance baffle is that it cannot be used in any portion of the paper path where the paper is physically being held in position such as in a roll nip. The operation of the jam clearance baffle is very simple in that it strips or lifts the copy sheet from the path so that it can be easily removed without the possibility of damage or injury to the photoreceptor or to the operator. In the embodiments illustrated in FIGS. 1–4, it is possible for the lower guide member to be part of the main machine frame with the upper guide member together with the U-shape member being pivotable into and out of the open and close positions. Alternatively, it is also possible for the entire jam clearance bafffle to be pivotally mounted. In this embodiment the lower guide member would be fixedly attached to, for example, a pivotable mount for the upper guide member.

Thus according to the present invention, a novel jam clearance device which is simple in fabrication as well as in operation is provided such that when a copy sheet jam takes place in the paper path, it may be readily cleared by the operator while minimizing the opportunity for personal injury as well as the opportunity for damage to the photoreceptor surface or other adjustments.

While the present invention has been illustrated with regard to essentially solid straight guide members, it will be appreciated that any suitable guide member may be used. For example, the guide members may be made from molded plastic or from wire form members and they may be arcuate in configuration when the sheet so requires.

While the invention has been described with reference to specific embodiments it will be apparent to those skilled in the art that many alternatives, modifications, variations may be made. Accordingly, it is intended to embrace such modifications and alternatives as may fall within the spirit and scope of the appended claims.

What is claimed is:

1. Sheet transport apparatus comprising a first sheet guide member partially defining a portion of a sheet transport path, a second sheet guide member in opposed spaced guiding relationship to said first guide member and defining therebetween a portion of a sheet transport path, said second sheet guide member being pivotally mounted at its upstream end and having attached at is downstream end a U-shaped member which extends from said second sheet guide member through the defined sheet transport path and into the plane of said first sheet guide member defining an aperture therein enclosing a cross sectional slice of said transport path whereby when a sheet is transported through said portion of said sheet transport path it passes within the aperture formed by the U-shaped member and the second sheet guide member.

2. The sheet transport apparatus according to claim 1, wherein said second sheet guide member has a handle means to pivot said second sheet guide means about its pivot mount away from said first sheet guide member whereby any sheet contained within the U-shaped member is withdrawn from the paper path.

3. The sheet transport apparatus according to claim 1, wherein said second sheet guide member is on top of said first sheet guide member.

4. The sheet transport apparatus according to claim 1, wherein said first sheet guide member is on top of said second sheet guide member.

5. The sheet transport apparatus according to claim 1, wherein said second sheet guide member is pivotally mounted about a hinge which spring biases the second sheet guide member to the open position.

6. The sheet transport apparatus according to claim 1, wherein a friction pad is attached to the inside of said U-shaped member to provide a sheet returning surface for a sheet contained within said aperture.

7. Reproducing apparatus comprising means to form a toner image on an imaging surface, means to fix a toner image on a copy sheet substrate, a copy sheet transport means to transport a copy sheet from a copy sheet supply to the imaging surface so that the lead edge of the copy sheet is in registration with the lead edge of the toner image on the image surface, means to transfer said toner image to the copy sheet, said copy sheet transport means further including means to transport said copy sheet with a transferred toner image thereon to a means for fixing said toner image, said copy sheet transport means comprising in part a first sheet guide member partially defining a portion of a sheet transport path, a second sheet guide member in opposed spaced guiding relationship to said first guide member and defining therebetween a portion of a sheet transport path, said second sheet guide member being pivotally mounted at its upstream end and having attached to its downstream end a U-shaped member which extends from said second sheet guide member through the defined sheet transport path and into the plane of said first sheet guide member defining an aperture therein enclosing a cross sectional slice of said transport path whereby when a sheet is transported through said portion of said sheet transport path it passes within the aperture formed by the U-shaped member and the second sheet guide member.

8. Reproducing apparatus according to claim 7, wherein said second sheet guide member has a handle means to pivot said second sheet guide means about its pivot mount away from said first sheet guide member whereby any sheet contained within the U-shaped member is withdrawn from the paper path.

9. Reproducing apparatus according to claim 7, wherein said second sheet guide member is on top of said first guide member.

10. Reproducing apparatus according to claim 7, wherein said first sheet guide member is on top of said second sheet guide member.

11. Reproducing apparatus according to claim 7, wherein said second sheet guide member is pivotally mounted about a hinge which spring biases the second sheet guide member to the open position.

12. Reproducing apparatus according to claim 7, wherein a friction pad is attached to the inside of said U-shaped member to provide a sheet returning surface for a sheet contained within said aperature.

13. Reproducing apparatus according to claim 7, wherein said first and second sheet guide members are adjacent to and deliver the copy sheet to the imaging surface for transfer of the toner image to the copy sheet.

14. Reproducing apparatus according to claim 13, wherein said imaging surface is a rotatable drum.

15. Reproducing apparatus according to claim 7, wherein said first and second sheet guide members are adjacent to and deliver the copy sheet to the toner image fixing means.

* * * * *